US010350618B2

(12) United States Patent
Yu

(10) Patent No.: US 10,350,618 B2
(45) Date of Patent: Jul. 16, 2019

(54) SHOWER HEAD CAPABLE OF AUTOMATIC SWITCHING AND MANUAL POSITIONING

(71) Applicant: SINYU TECHNOLOGY (FUJIAN) CO., LTD., Zhangzhou (CN)

(72) Inventor: Zhangjun Yu, Zhangzhou (CN)

(73) Assignee: SINYU TECHNOLOGY (FUJIAN) CO., LTD., Zhangzhou, Fujian (CN)

( * ) Notice: Subject to any disclaimer, the term of this patent is extended or adjusted under 35 U.S.C. 154(b) by 751 days.

(21) Appl. No.: 14/910,067

(22) PCT Filed: Oct. 24, 2012

(86) PCT No.: PCT/CN2012/083435

§ 371 (c)(1),
(2) Date: Feb. 4, 2016

(87) PCT Pub. No.: WO2014/063318

PCT Pub. Date: May 1, 2014

(65) Prior Publication Data

US 2016/0184840 A1 Jun. 30, 2016

(51) Int. Cl.

*B05B 1/16* (2006.01)
*B05B 1/18* (2006.01)
*E03C 1/04* (2006.01)

(52) U.S. Cl.

CPC ..... *B05B 1/1636* (2013.01); *B05B 1/18* (2013.01); *E03C 1/0409* (2013.01)

(58) Field of Classification Search

CPC ..... B05B 1/18; B05B 1/1636; B05B 1/185; B05B 1/1663; B05B 3/04; E03C 1/0409; E03C 1/08

See application file for complete search history.

(56) References Cited

U.S. PATENT DOCUMENTS 2,726,120 A * 12/1955 Bletcher ..... B05B 1/18 239/449
3,632,083 A * 1/1972 Meeks ..... A61C 17/0202 251/282
3,682,392 A * 8/1972 Kint ..... E03C 1/08 137/625.5
3,722,798 A * 3/1973 Bletcher ..... E03C 1/084 137/625.5
5,172,866 A * 12/1992 Ward ..... B05B 1/1663 239/446
5,862,985 A * 1/1999 Neibrook ..... B05B 1/1636 239/428.5
6,557,587 B1 * 5/2003 Chiu ..... E03C 1/04 137/801
6,722,391 B2 * 4/2004 Gabrel ..... G05D 16/107 137/625.69

(Continued)

*Primary Examiner* — Arthur O. Hall
*Assistant Examiner* — Steven M Cernoch
(74) *Attorney, Agent, or Firm* — Lucas & Mercanti, LLP

(57) ABSTRACT

A shower head capable of automatic switching and manual positioning is provided. By pressing buttons, a tension spring brings a final-stage small gear of a gear transmission unit to mesh with a switching gear. A rotor drives the switching gear through the gear transmission unit, enabling a water hole of the switching gear to align with one of water diversion holes of a water diversion seat for automatic switching to provide different outflow modes. The shower head implements function switching with one hand and is convenient to use.

2 Claims, 16 Drawing Sheets

(56) References Cited

U.S. PATENT DOCUMENTS

| | | | | |
|---|---|---|---|---|
| 7,818,828 | B2 * | 10/2010 | Zhou | B05B 1/1663 137/883 |
| 8,297,538 | B2 * | 10/2012 | Zhou | B05B 1/1636 239/391 |
| 8,573,512 | B2 * | 11/2013 | Hu | B05B 1/1663 239/443 |
| 9,427,749 | B2 * | 8/2016 | Zhou | B05B 1/1636 |

* cited by examiner

SHOWER HEAD CAPABLE OF AUTOMATIC SWITCHING AND MANUAL POSITIONING

BACKGROUND OF THE INVENTION

1. Field of the Invention

The present invention relates to a shower head, and more particularly to a shower head capable of automatic switching and manual positioning.

2. Description of the Prior Art

A conventional shower head implements function switching in a rotating manner. When the shower head is switched, one hand holds a shower head main body and the other hand holds a rotating unit composed of a face plate and other parts. By rotating the face plate of the rotating unit, the shower head provides different outflow modes. It needs both hands to implement function switching for the existing shower heads. It is inconvenient for use. Accordingly, the inventor of the present invention has devoted himself based on his many years of practical experiences to solve these problems.

SUMMARY OF THE INVENTION

The primary object of the present invention is to provide a shower head capable of automatic switching and manual positioning. The shower head implements function switching with one hand and is convenient to use.

In order to achieve the aforesaid object, the shower head capable of automatic switching and manual positioning of the present invention comprises a body, a face plate, a water diversion plate, a water diversion seat, a rotor, a gear transmission unit, a switching gear, a first switching block, a second switching block, a connecting rod, buttons, a stop pin, and a stop seat. The water diversion plate is buckled on the body to form functional water channels and a water inlet channel. The face plate is disposed on top of the water diversion plate. The water diversion seat used for dividing the functional water channels from the water inlet channel is installed at a position where all the functional water channels converge. The switching gear is installed on the water diversion seat in a rotatable manner. The switching gear is formed with a water hole corresponding to water diversion holes of the water diversion seat. The rotor is installed at a water inlet of the body. The rotor drives the switching gear through the gear transmission unit. The gear transmission unit comprises a final-stage small gear installed on the second swinging block to mesh with the switching gear. The second swinging block is installed in the body through a second switching shaft. The second swinging block is formed with a first limiting face, a second limiting face, a first stop groove, and a second stop groove. The first swinging block is installed on the second swinging block through a first switching shaft. The first swinging block is formed with a first limiting block and a second limiting block to cooperate with the first limiting face and the second limiting face. The first swinging block is further formed with a slope to cooperate with a positioning column of the switching gear and a push lever to cooperate with the connecting rod. A tension spring is provided between the first switching block and the second switching block. The stop seat is installed in the body. A spring and the stop pin are installed in the stop seat. The stop pin is biased by the spring to cooperate with the first stop groove and the second stop groove. The connecting rod is installed in the body. The connecting rod is formed with a push surface to cooperate with the push lever of the first switching block. Two ends of the connecting rod are provided with the buttons. The buttons extend out of the body. Sealing members are provided between the aforesaid parts.

Preferably, the body is formed with an oblique water trough between the water inlet channel and the water inlet. The oblique water trough is formed with an oblique opening facing the water inlet. The rotor is installed in the oblique trough.

Preferably, the connecting rod has a ⅃-shaped cross-section. The buttons are disposed on two side rods. The push surface is disposed on a middle transverse rod.

When the present invention is used, the buttons are pressed. The tension spring brings the final-stage small gear of the gear transmission unit to mesh with the switching gear. The rotor drives the switching gear through the gear transmission unit, enabling the water hole of the switching gear to align with one of the water diversion holes of the water diversion seat for automatic switching to provide different outflow modes. When the shower head is in the state of the desired outflow mode, the buttons are pressed again. The connecting rod brings the final-stage small gear of the gear transmission unit to disengage from the switching gear. The stop pin cooperates with the second stop groove to position the second switching block. The slope of the first switching block cooperates with the positioning column of the switching gear to stop the switching gear. The shower head is operated manually to be in the state of the desired outflow mode.

The present invention can be operated in a press manner instead of a traditional rotating manner. The shower head implements function switching with one hand and is convenient to use.

BRIEF DESCRIPTION OF THE DRAWINGS

FIG. 6-1 is a perspective view showing the automatic and manual switching of the present invention;

FIG. 7-1 is a first schematic view showing the cooperation between the first switching block and the second switching block of the present invention;

FIG. 7-2 is a second schematic view showing the cooperation between the first switching block and the second switching block of the present invention;

FIG. 8-1 is a first schematic view showing the operation of the automatic and manual switching to be positioned of the present invention;

FIG. 8-2 is a second schematic view showing the operation of the automatic and manual switching to be positioned of the present invention;

FIG. 8-3 is an exploded view showing the stop seat and the stop pin of the present invention;

FIG. 9-1 is a first schematic view showing the outflow switching of the present invention (outflow carried out by two modes);

FIG. 9-2 is a second schematic view showing the outflow switching of the present invention (outflow carried out by one mode);

FIG. 9-3 is a third schematic view showing the outflow switching of the present invention (outflow carried out by two modes);

FIG. 9-4 is a fourth schematic view showing the outflow switching of the present invention (outflow carried out by another mode);

FIG. 10-1 is a schematic view showing the automatic outflow mode of the present invention (without broken lines);

FIG. 10-2 is a schematic view showing the automatic outflow mode of the present invention (the connecting rod is hidden);

FIG. 10-3 is a perspective view showing the switching gear of the present invention;

FIG. 11-1 is a schematic view showing the manual positioning outflow mode of the present invention (without broken lines);

FIG. 11-2 is a schematic view showing the manual positioning outflow mode of the present invention (the connecting rod is hidden);

FIG. 12-1 is a schematic view showing the retaining outflow mode of the present invention (without broken lines); and FIG. 12-2 is a schematic view showing the retaining outflow mode of the present invention (the connecting rod is hidden).

DETAILED DESCRIPTION OF THE PREFERRED EMBODIMENTS

Embodiments of the present invention will now be described, by way of example only, with reference to the accompanying drawings.

Figure 1:
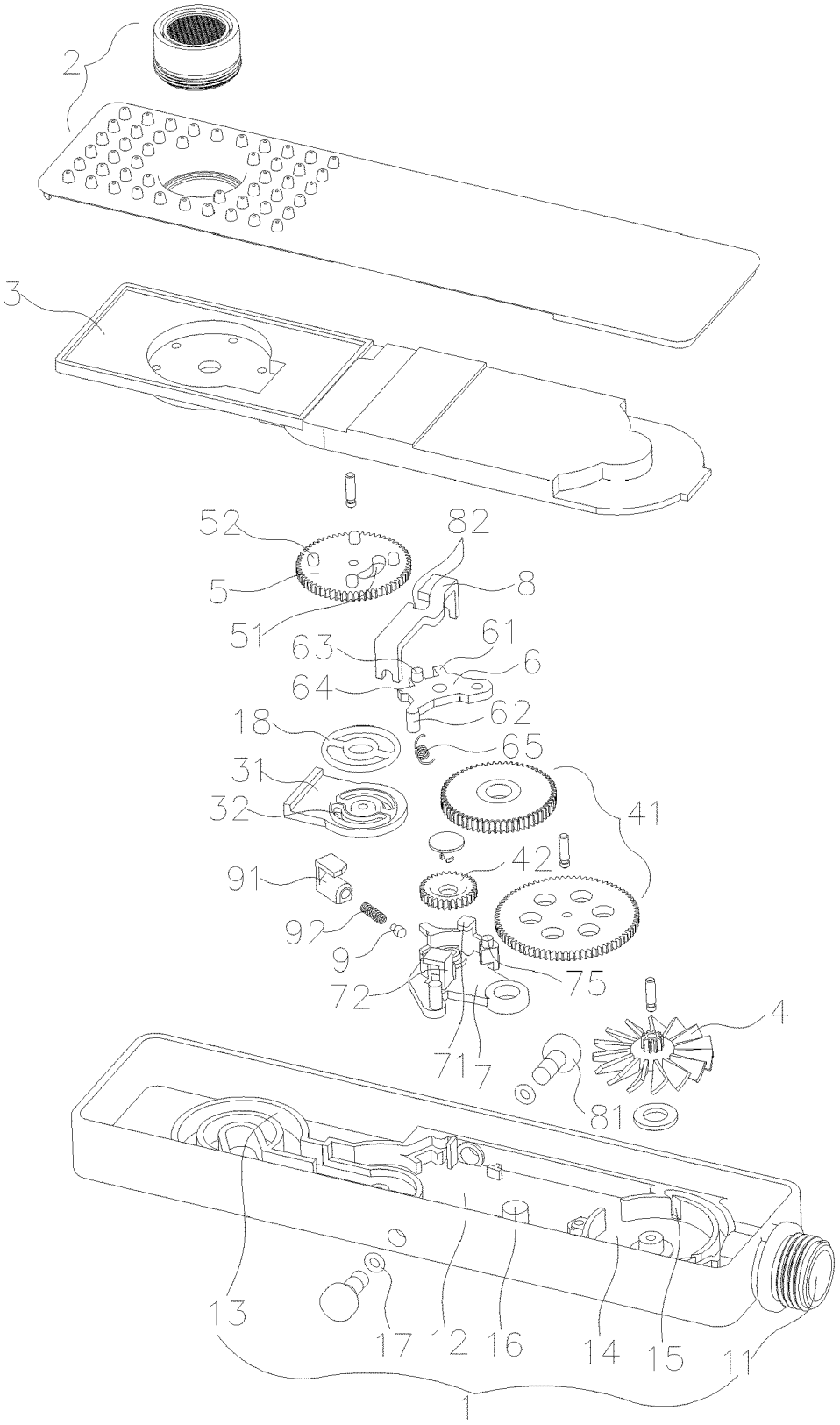
FIG. 1 is an exploded view of the present invention.
Figure 2:
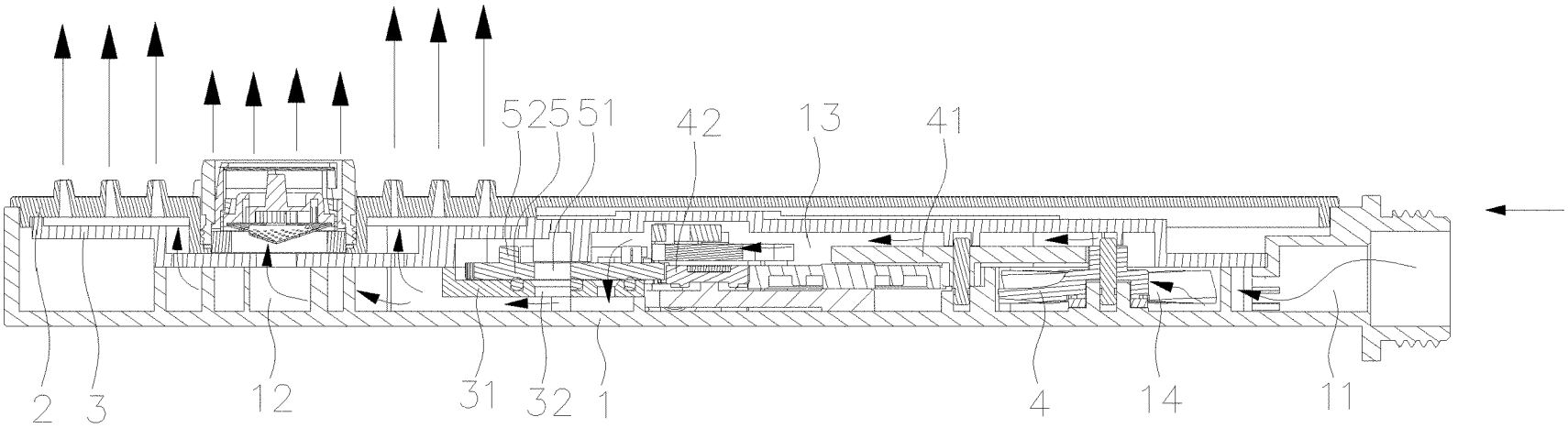
FIG. 2 is a sectional view of the present invention.
Figure 3:
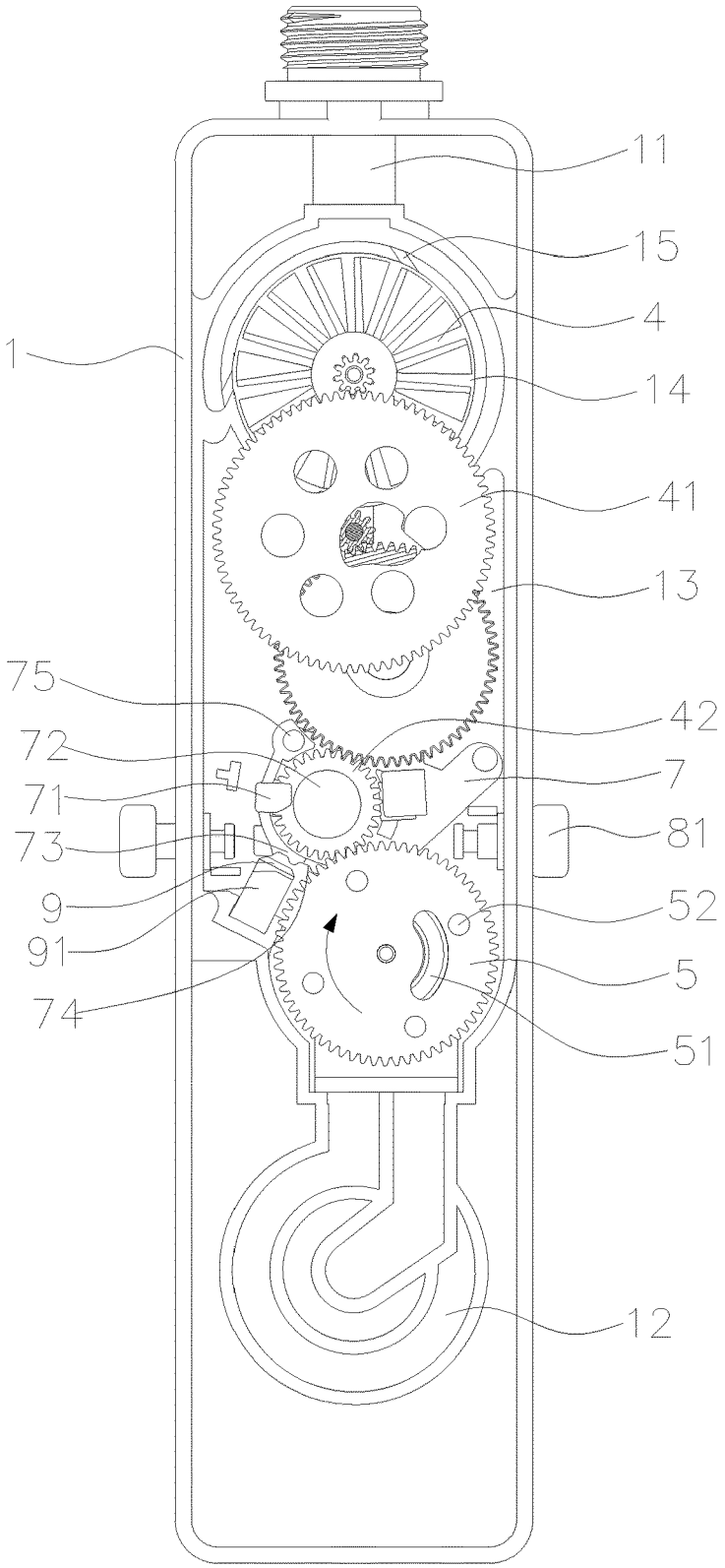
FIG. 3 is a schematic view showing the transmission of the present invention.

As shown in FIG. 1 through FIG. 3, a shower head capable of automatic switching and manual positioning according to a preferred embodiment of the present invention comprises a body 1, a face plate 2, a water diversion plate 3, a water diversion seat 31, a rotor 4, a gear transmission unit 41, a switching gear 5, a first switching block 6, a second switching block 7, a connecting rod 8, buttons 81, a stop pin 9, and a stop seat 91.

Figure 4:
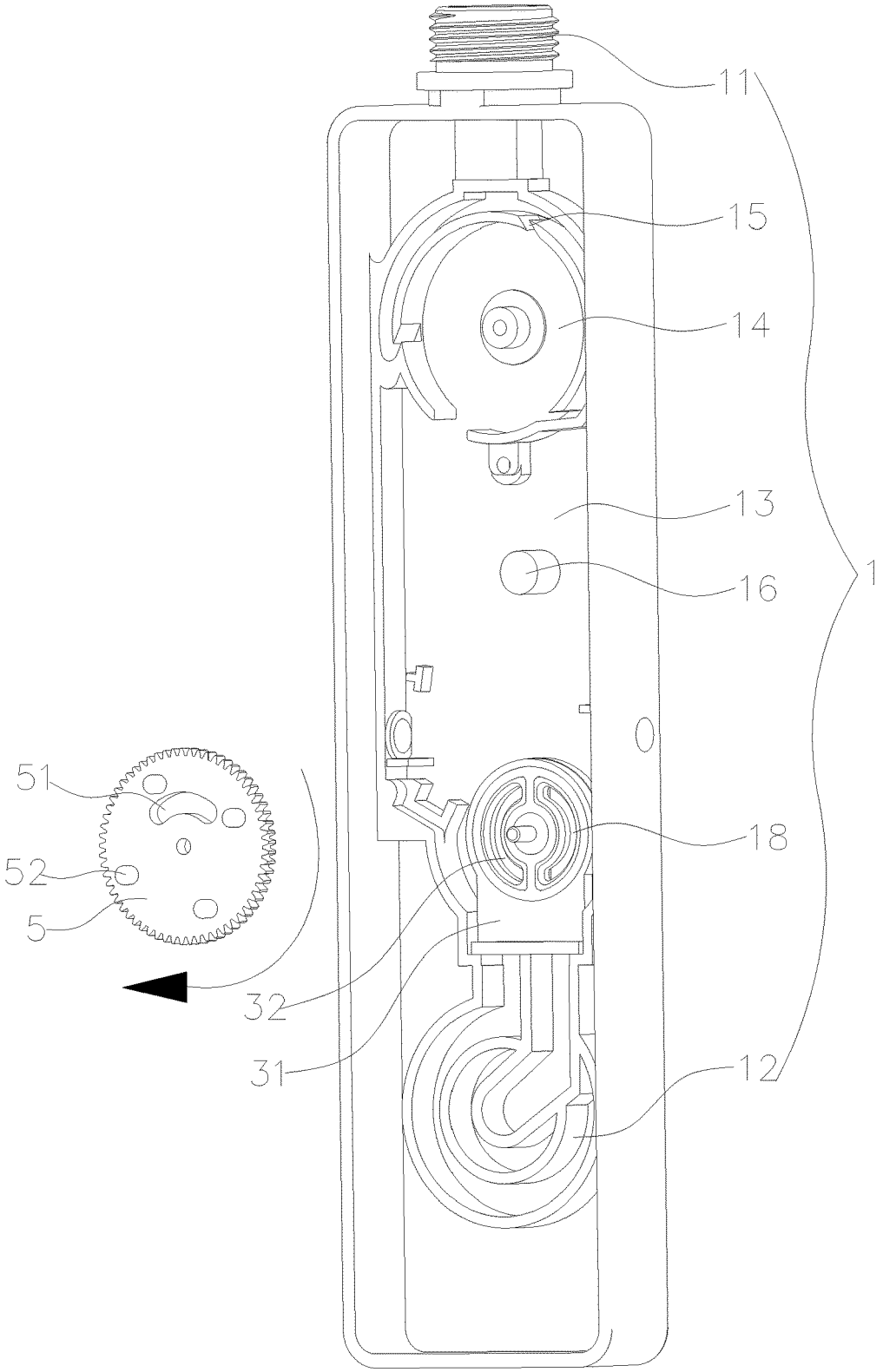
FIG. 4 is a schematic view showing the water channel switching of the present invention.
Figure 5:
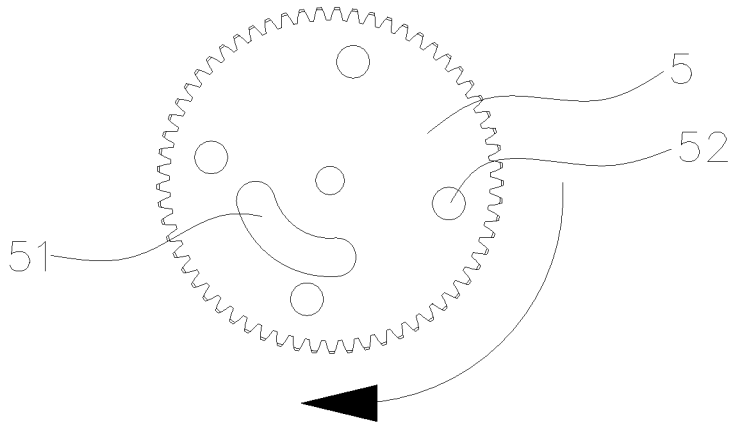
FIG. 5 is a schematic view showing the switching gear and the water diversion seat of the present invention.
Figure 5:
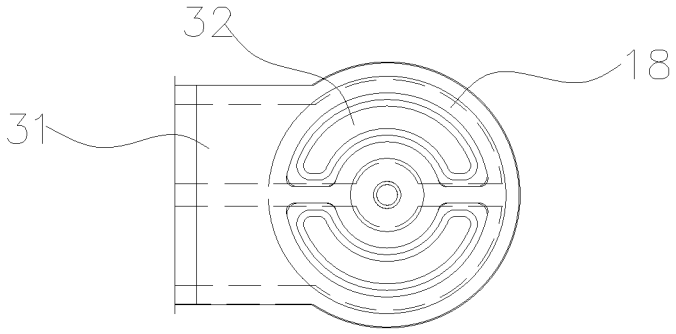
Figure 6:
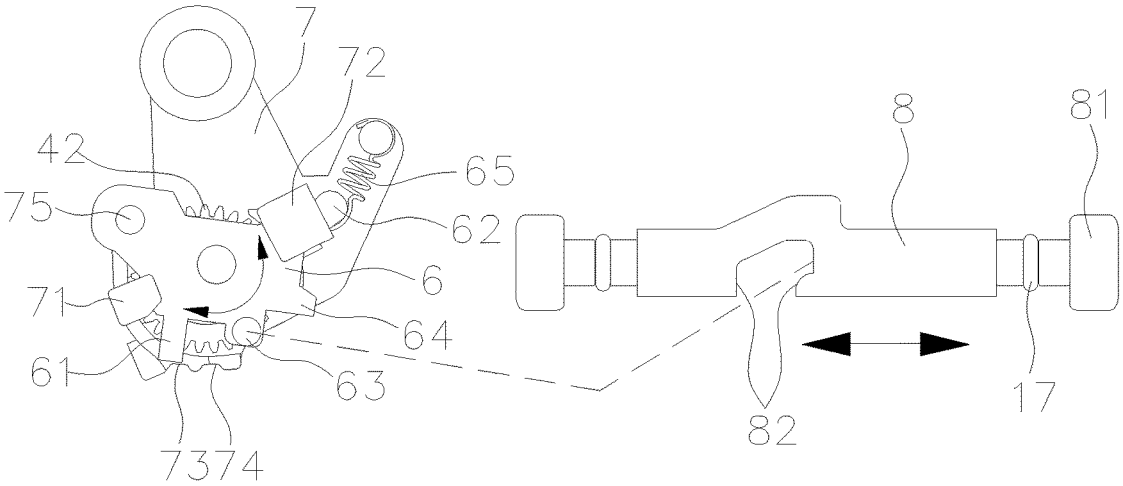
FIG. 6 is an exploded view showing the automatic and manual switching of the present invention.
Figures 1, 6:
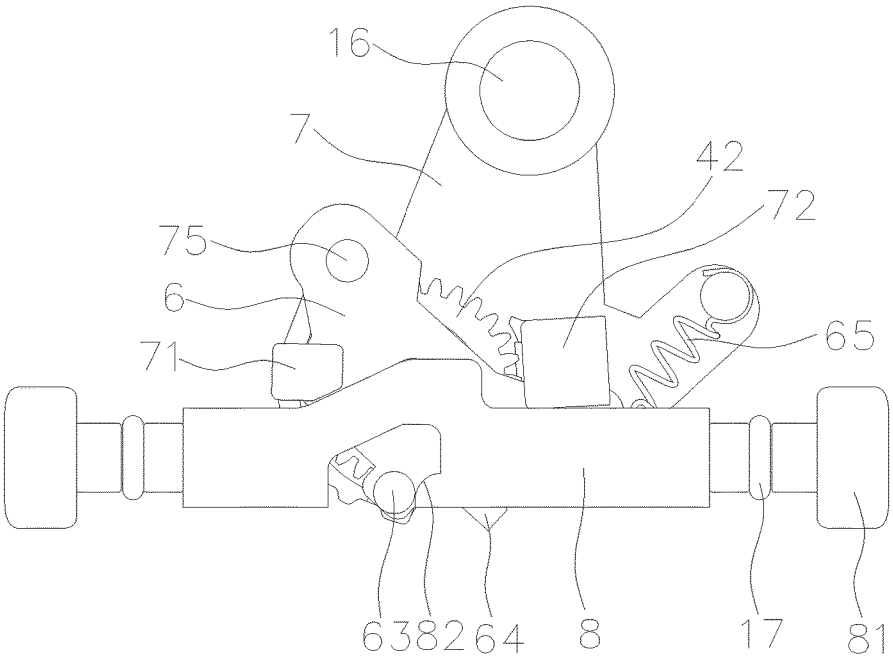
Figure 7:
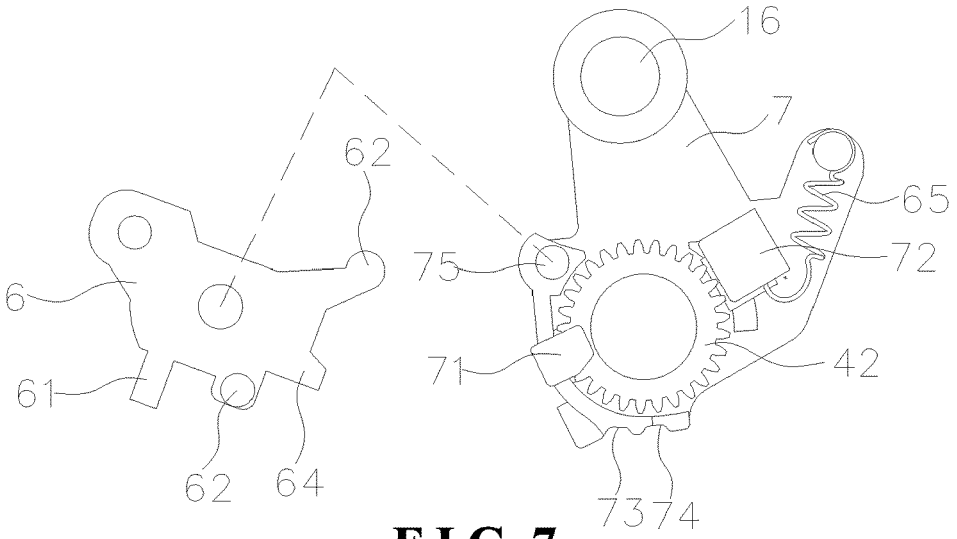
FIG. 7 is an exploded view showing the first switching block and the second switching block of the present invention.
Figures 1, 7:
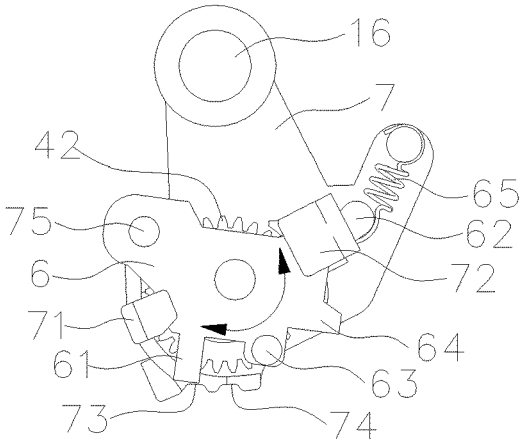
Figures 2, 7:
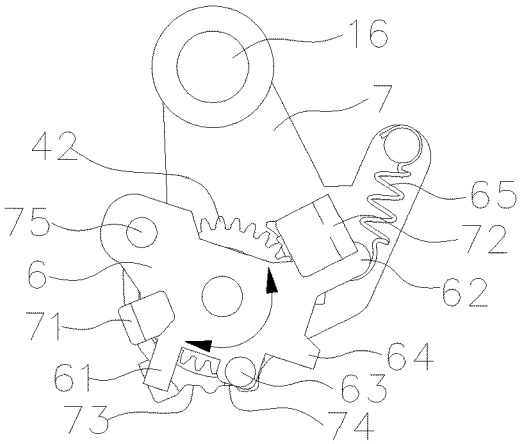
Figure 8:
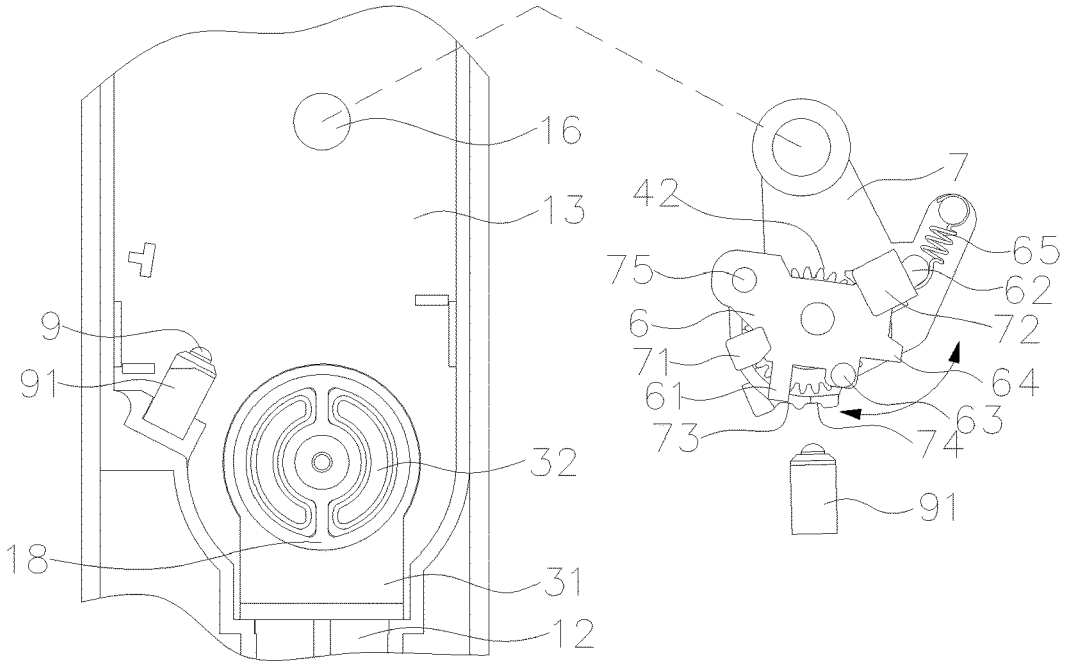
FIG. 8 is an exploded view showing the automatic and manual switching to be positioned of the present invention.
Figures 1, 8:
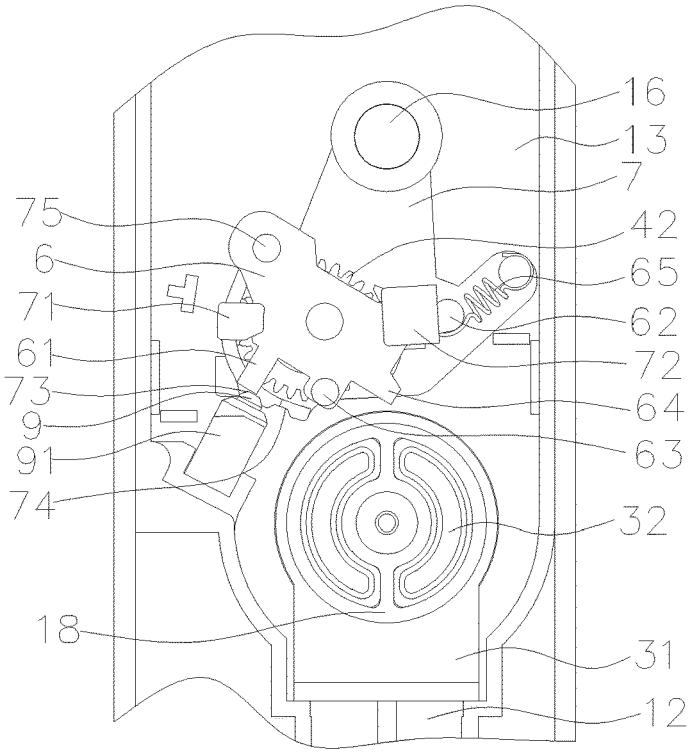
Figures 2, 8:
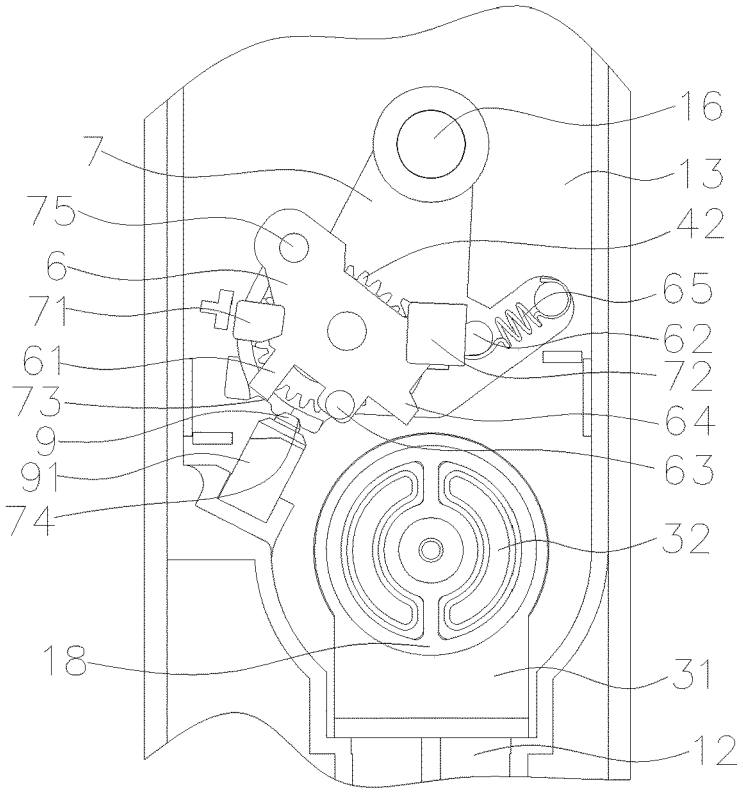
Figures 3, 8:
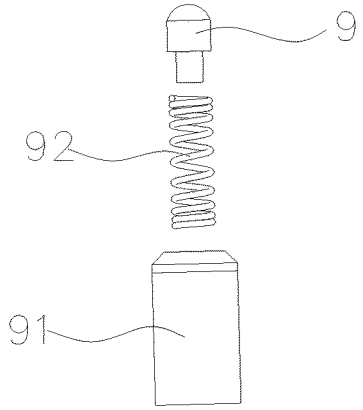
Figures 1, 9:
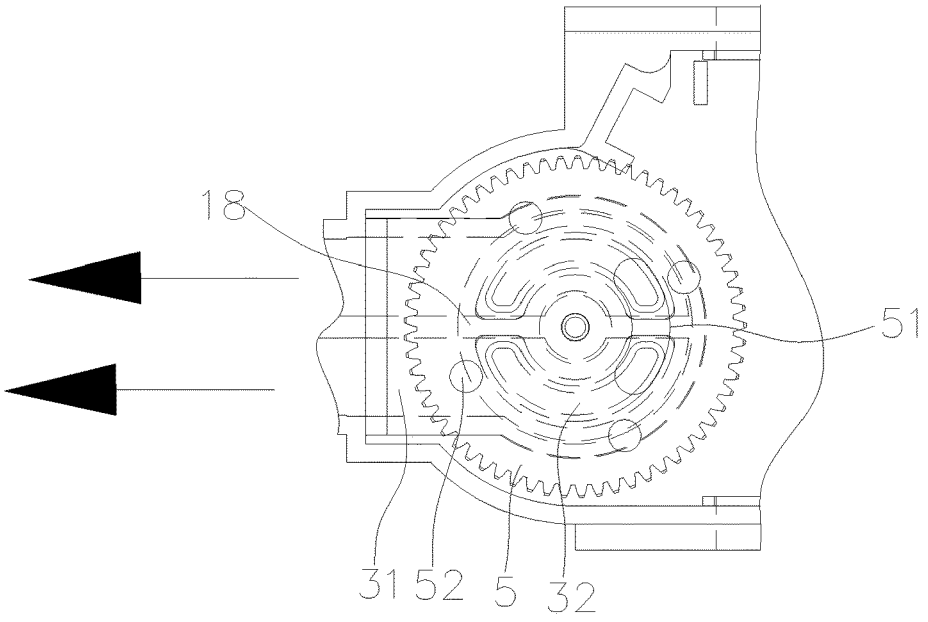
Figures 2, 9:
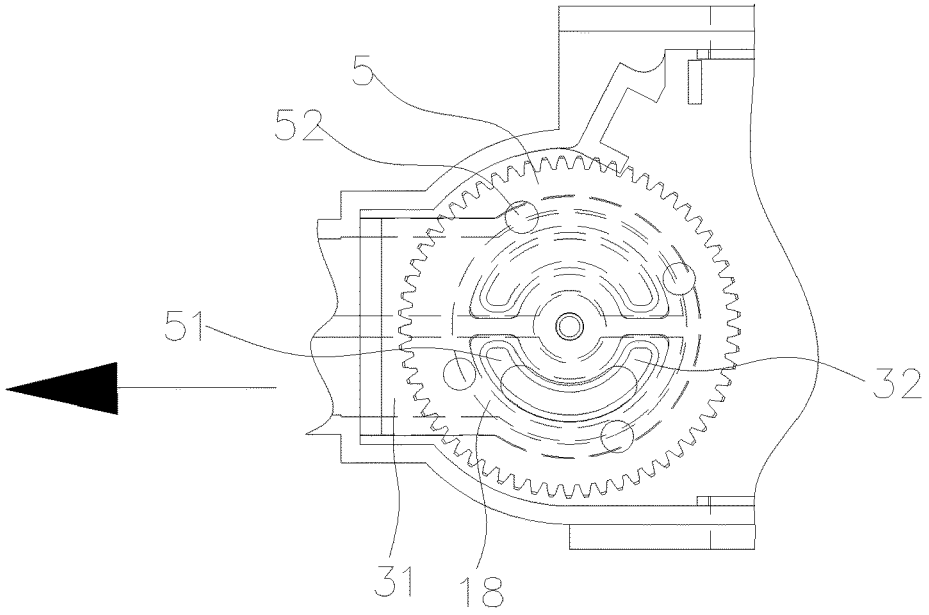
Figures 3, 9:
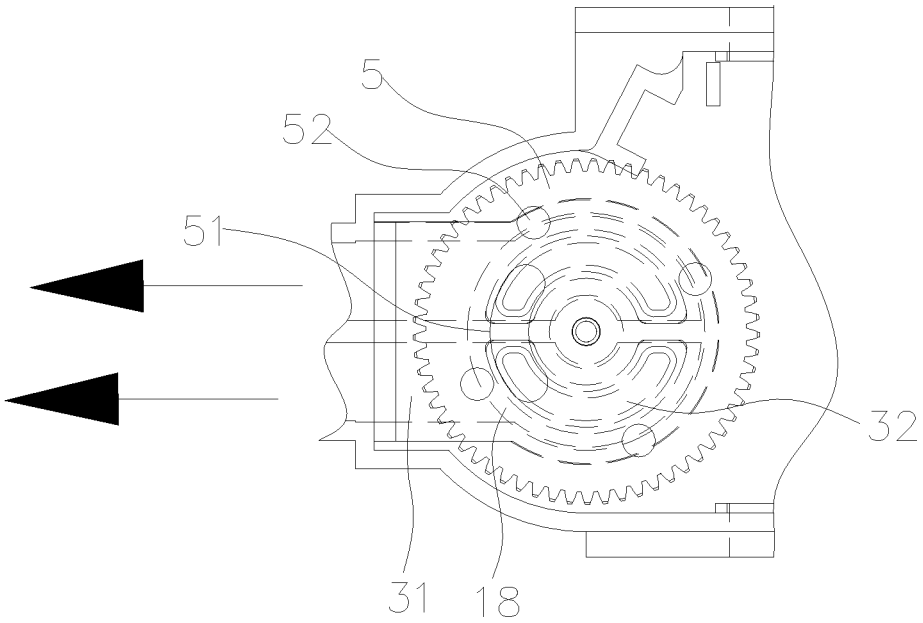
Figures 4, 9:
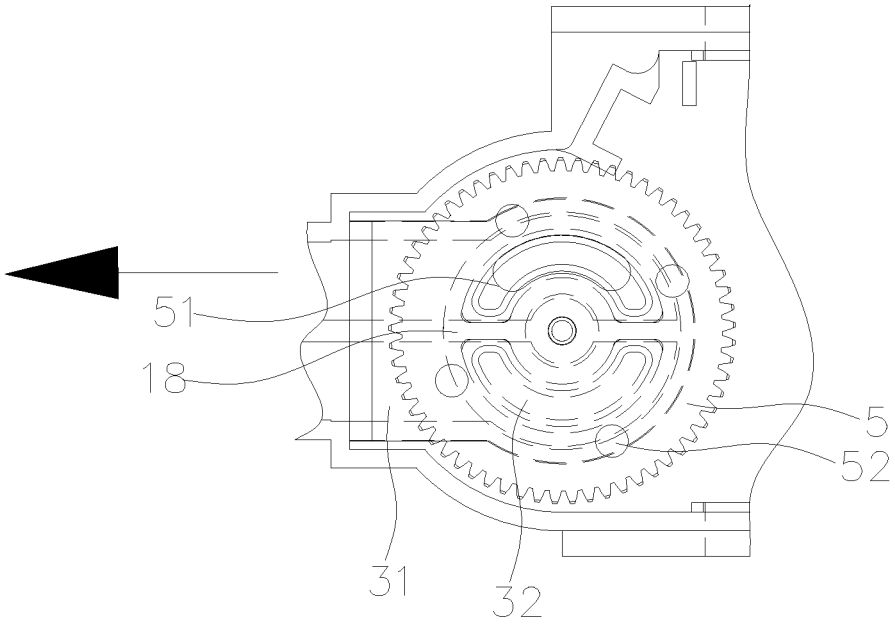

The body has a water inlet 11. The water diversion plate 3 is buckled on the body 1, such that two functional water channels 12 and a water inlet channel 13 are formed between the water diversion plate 3 and the body 1. The number of the functional water channels 12 depends on the design, not limited to this embodiment. The face plate 2 is disposed on top of the water diversion plate 3 and cooperates with the functional water channels to provide different outflow modes. The water diversion seat 31 used for dividing the functional water channels 12 from the water inlet channel 13 is installed at a position where all the functional water channels 12 converge. The switching gear 5 is installed on the water diversion seat 31 in a rotatable manner. The switching gear 5 is formed with a water hole 51 corresponding to water diversion holes 32 of the water diversion seat 31, as shown in FIG. 4 and FIG. 5, the switching gear 5 is rotated to align the water hole 51 with a corresponding one of the water diversion holes 32 to implement different outflow modes, as shown in FIG. 9-1 to FIG. 9-4. The switching gear 5 is further provided with a positioning column 52 to retain the outflow state. In this embodiment, there are two functional water channels 12 to provide three outflow modes. Thus, the switching gear 5 is provided with four symmetrical positioning columns 52 accordingly.

The rotor 4 is installed at the water inlet 11 of the body 1 for installing conveniently and ensuring that the rotor 4 works effectively. In this embodiment, the body 1 is formed with an oblique water trough 14 between the water inlet channel 13 and the water inlet 11. The oblique water trough 14 is formed with an oblique opening 15 facing the water inlet 11. The rotor 4 is installed in the oblique trough 14. Water flows from the water inlet 11 to the body 1 through the oblique opening 15 to enter the oblique trough 14 so as to lash the rotor 4, such that the rotor 4 is turned to work. The rotor 4 drives the switching gear 5 through the gear transmission unit 41. The gear transmission unit 41 can be a multi-stage transmission unit. The gear transmission unit 41 comprises a final-stage small gear 42 installed on the second swinging block 7 to mesh with the switching gear 5.

Referring to FIG. 6 through FIG. 8-2, the second swinging block 7 is installed in the body 1 through a second switching shaft 16 on the main body 1. The second swinging block 7 is formed with a first limiting face 71, a second limiting face 72, a first stop groove 73, and a second stop groove 74.

The first swinging block 6 is installed on the second swinging block 7 through a first switching shaft 75 on the second swinging block 7. The first swinging block 6 is formed with a first limiting block 61 and a second limiting block 62 to cooperate with the first limiting face 71 and the second limiting face 72. The first swinging block 6 is further formed with a slope 63 to cooperate with the positioning column 52 of the switching gear 5 and a push lever 64 to cooperate with the connecting rod 8. A tension spring 65 is provided between the first switching block 6 and the second switching block 7.

The stop seat 91 is installed in the body 1. A spring 92 and the stop pin 9 are installed in the stop seat 91. The stop pin 9 is biased by the spring 92 to cooperate with the first stop groove 73 and the second stop groove 74.

The connecting rod 8 is installed in the body 1. The connecting rod 8 is formed with a push surface 82 to cooperate with the push lever 64 of the first switching block 6. Two ends of the connecting rod 8 are provided with the buttons 81. The buttons 81 extend out of the body 1 to be operated conveniently. For convenient assembly, the connecting rod 8 of this embodiment has a □-shaped cross-section. The buttons 81 are disposed on two side rods, and the push surface 82 is disposed on a middle transverse rod.

Sealing members are provided between the aforesaid parts to enhance effect, such as O-shaped rings 17 and sealing gaskets 18.

Figure 10:
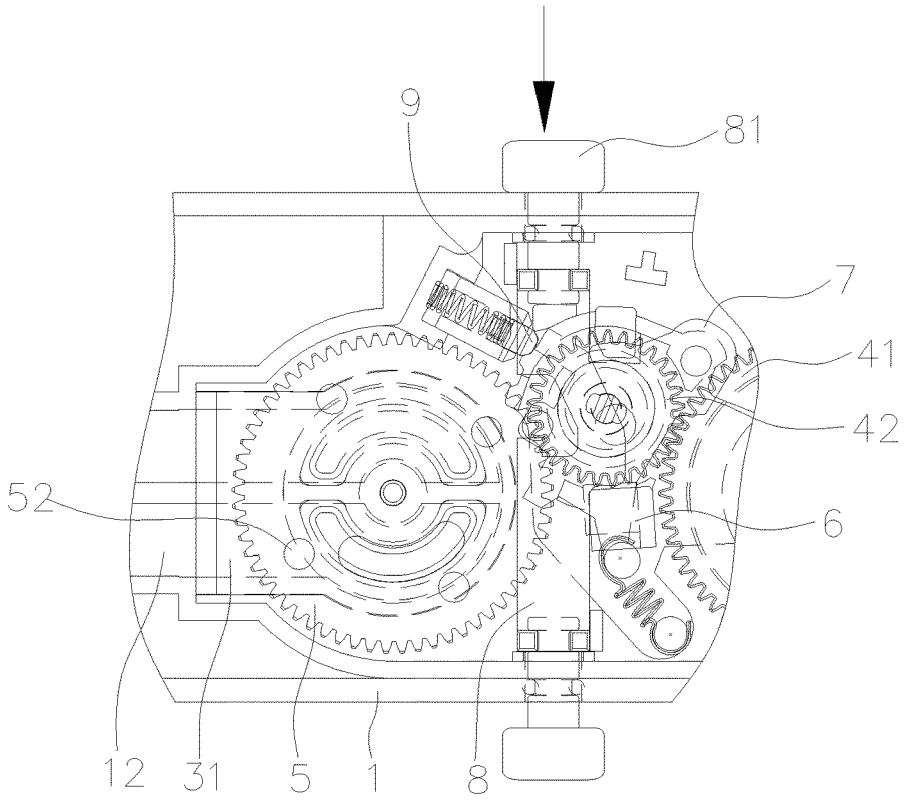
FIG. 10 is a schematic view showing the automatic outflow mode of the present invention (with broken lines)
Figures 1, 10:
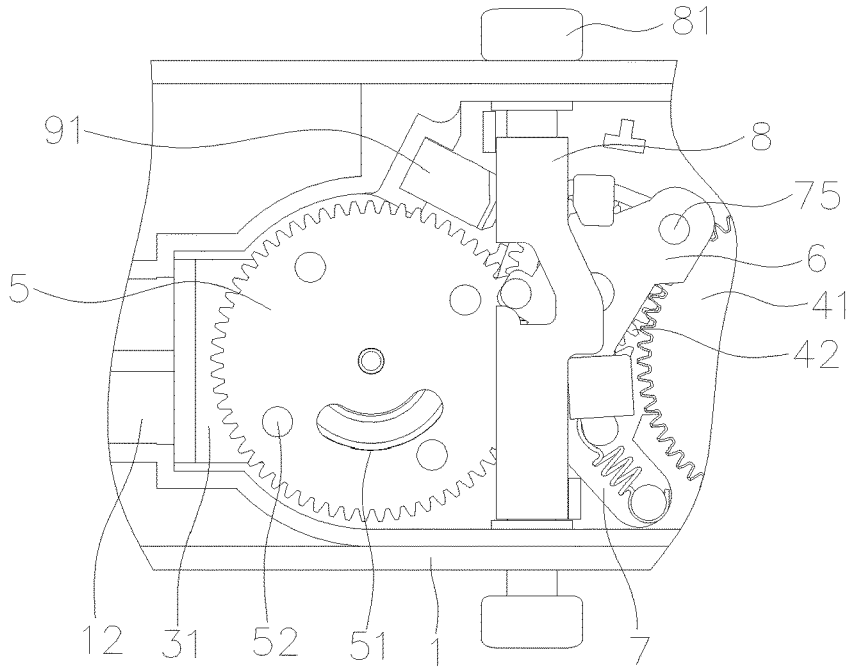
Figures 2, 10:
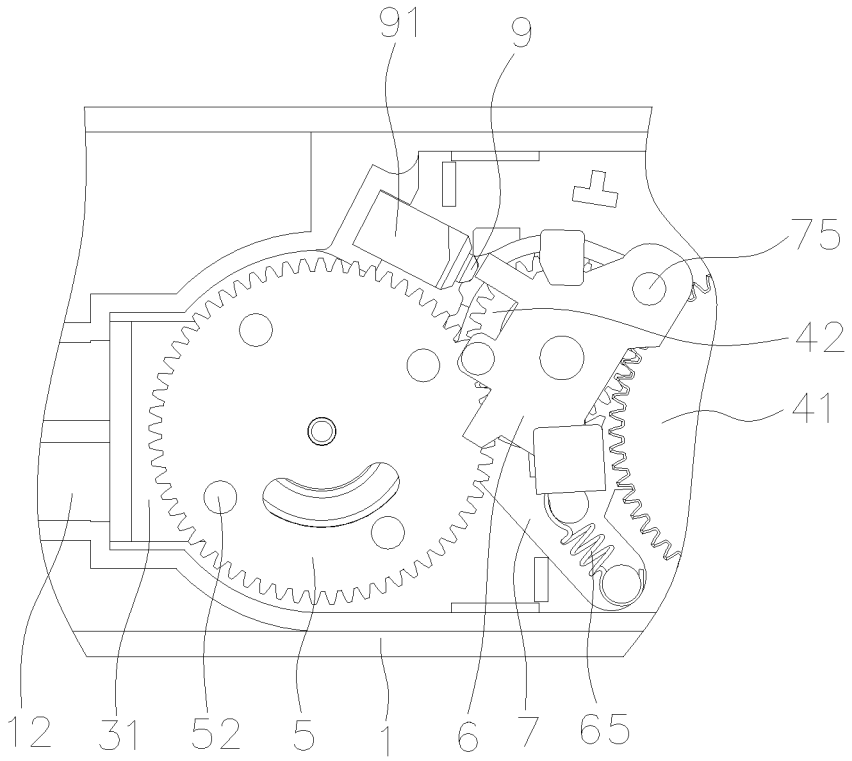
Figures 3, 10:
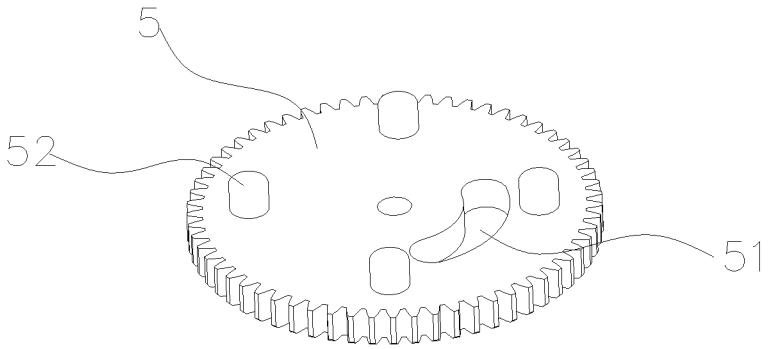

When the present invention is used, as shown in FIG. 10 to FIG. 10-2, the first switching block 6 biased by the tension spring 65 acts on the second switching block 7 to deflect counterclockwise until the second limiting block 62 leans against the second limiting face 72. The buttons 81 are pressed in the direction of the arrow. The push surface 82 of the connecting rod 8 is to push the push lever 64 of the first switching block 6 down, such that the first switching block 6 and the second switching block 7 are turned counterclockwise to bring the final-stage small gear 42 of the gear transmission unit 41 on the second switching block 7 to mesh with the switching gear 5. The stop pin 9 is engaged in the first stop groove 73 to position the second switching block 7. Water flows from the water inlet 11 to lash the rotor 4. The rotor 4 drives the switching gear 5 through the gear transmission unit 41, enabling the water hole 51 of the switching gear 5 to align with one of the water diversion holes 32 of the water diversion seat 31, as shown in FIG. 9-1 to FIG. 9-4, for automatic switching to provide different outflow modes.

Figure 11:
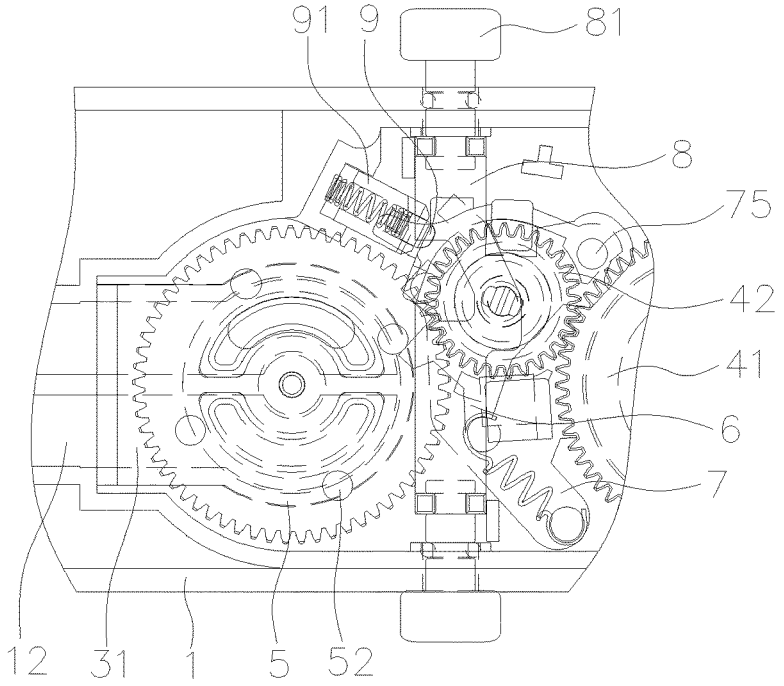
FIG. 11 is a schematic view showing the manual positioning outflow mode of the present invention (with broken lines)
Figures 1, 11:
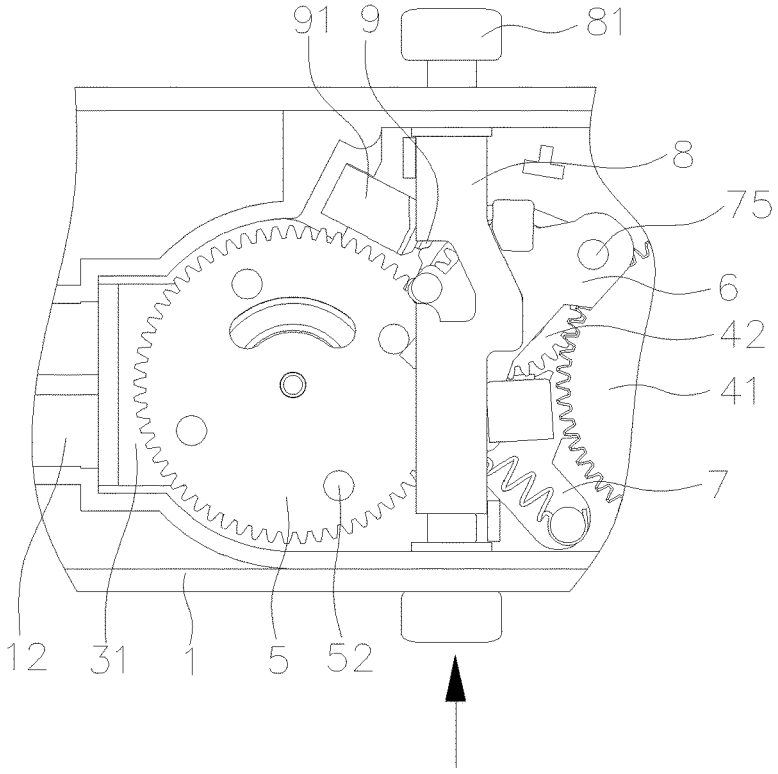
Figures 2, 11:
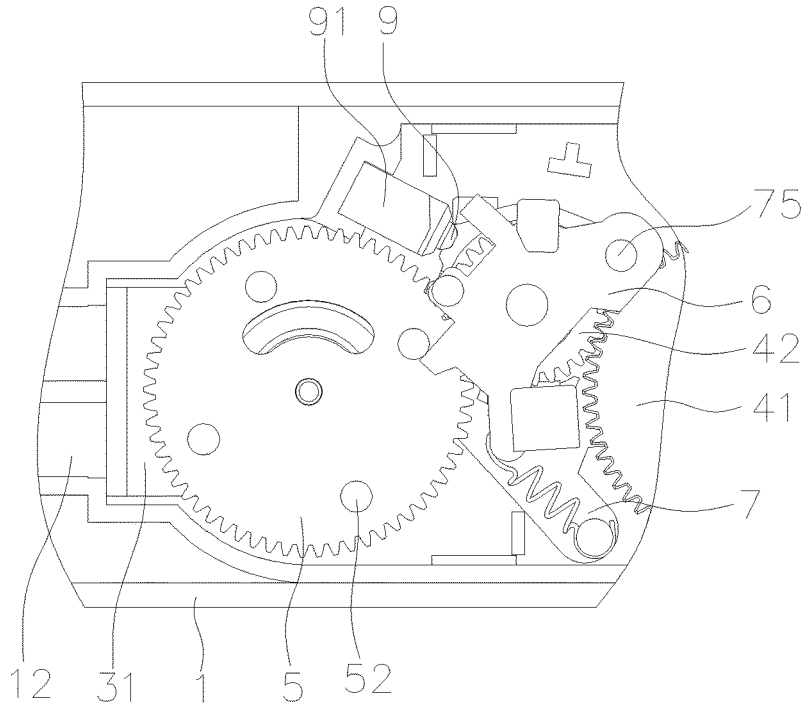
Figure 12:
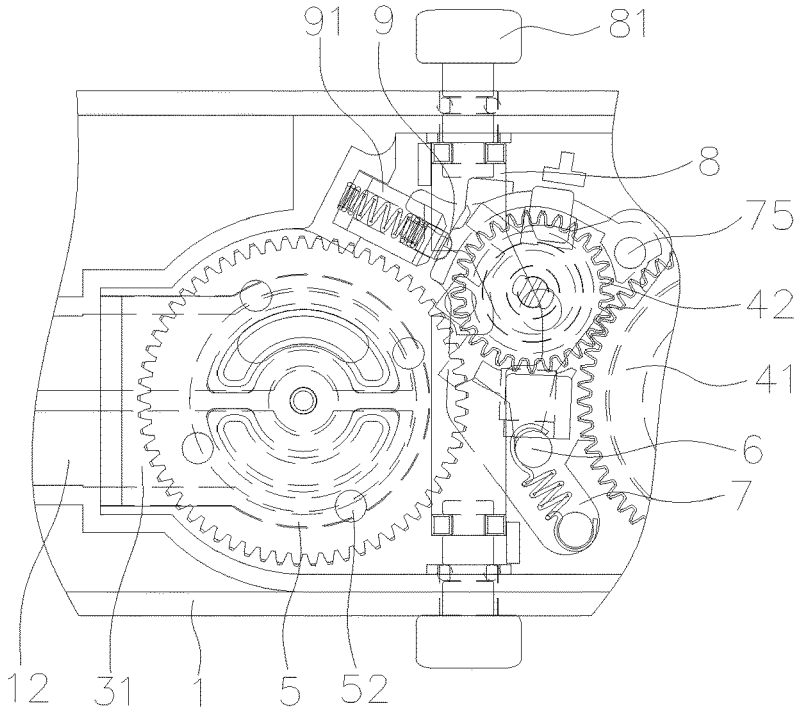
FIG. 12 is a schematic view showing the retaining outflow mode of the present invention (with broken lines)
Figures 1, 12:
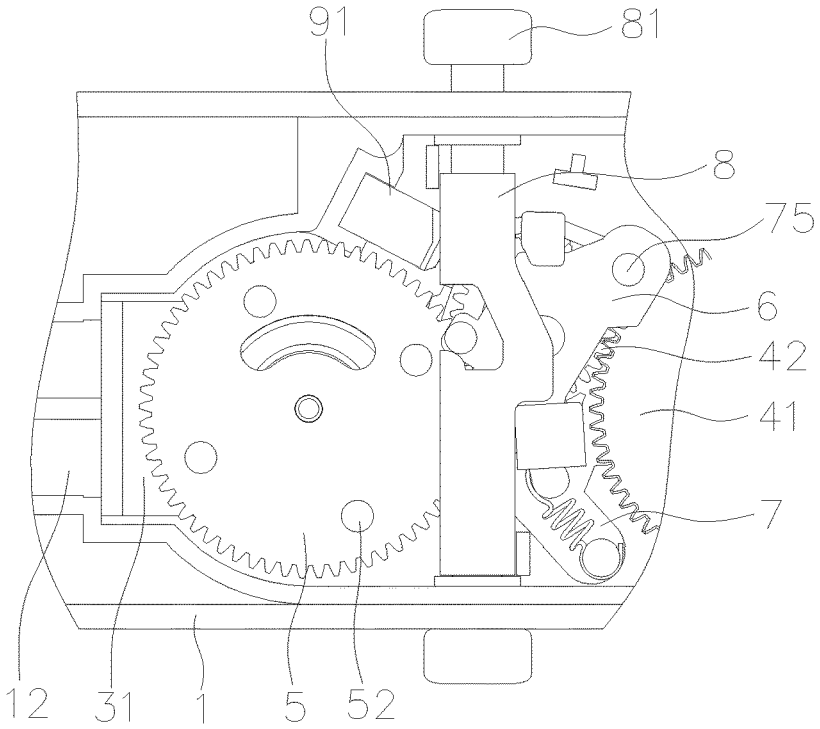
Figures 2, 12:
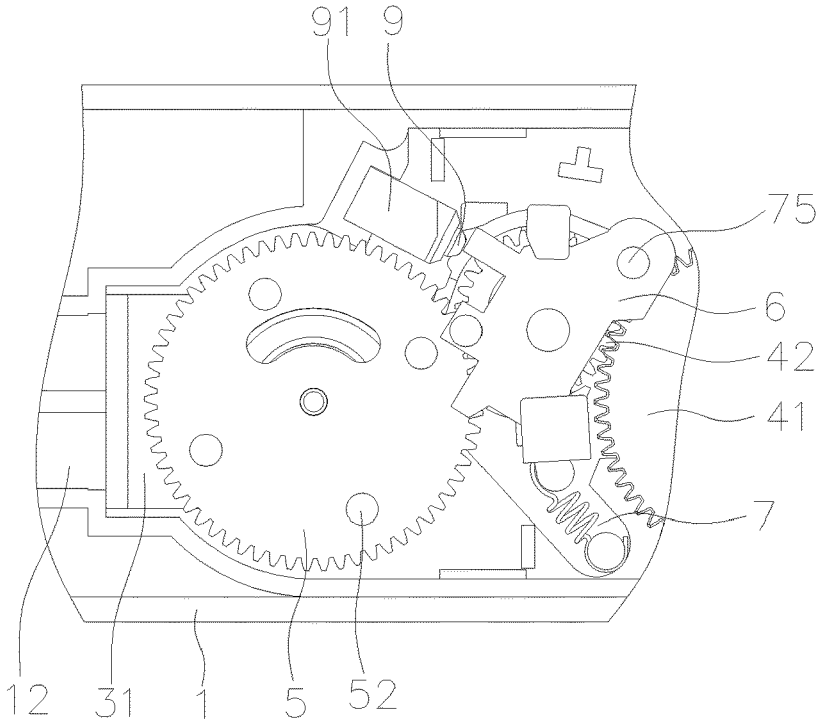

When the shower head is in the state of a desired outflow mode, as shown in FIG. 11 to FIG. 11-2, the buttons 81 are pressed in the direction of the arrow. The push surface 82 of the connecting rod 8 is to push the push lever 64 of the first switching block 6 up, such that the first switching block 6 is first defected clockwise until the first switching block 6 leans against the first limiting surface 71. After that, the push surface 82 of the connecting rod 8 is further to push the push lever 64 of the first switching block 6 up, enabling the first switching block 6 and the second switching block 7 to be turned clockwise to bring the final-stage small gear 42 of the gear transmission unit 41 on the second switching block 7 to disengage from the switching gear 5. The slope 63 of the first switching block 6 cooperates with the positioning column 52 of the switching gear 5 to stop the switching gear 5. The stop pin 9 is engaged in the second stop groove 74 to position the second switching block 7. As shown in FIG. 12 to FIG. 12-2, the shower head is operated manually to be in the state of the desired outflow mode Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower head capable of automatic switching and manual positioning comprising: a body, a face plate, a water diversion plate, a water diversion seat, a rotor, a gear transmission unit, a switching gear, a first switching block, a second switching block, a connecting rod, buttons, a stop pin, and a stop seat; the water diversion plate being buckled on the body to form functional water channels and a water inlet channel; the face plate being disposed on top of the water diversion plate; the water diversion seat used for dividing the functional water channels from the water inlet channel being installed at a position where all the functional water channels converge; the switching gear being installed on the water diversion seat in a rotatable manner, the switching gear being formed with a water hole corresponding to water diversion holes of the water diversion seat; the rotor being installed at a water inlet of the body, the rotor driving the switching gear through the gear transmission unit, the gear transmission unit comprising a final-stage small gear installed on the second swinging block to mesh with the switching gear; the second swinging block being installed in the body through a second switching shaft, the second swinging block being formed with a first limiting face, a second limiting face, a first stop groove, and a second stop groove; the first swinging block being installed on the second swinging block through a first switching shaft, the first swinging block being formed with a first limiting block and a second limiting block to cooperate with the first limiting face and the second limiting face, the first swinging block being further formed with a slope to cooperate with a positioning column of the switching gear and a push lever to cooperate with the connecting rod, a tension spring being provided between the first switching block and the second switching block; the stop seat being installed in the body, a spring and the stop pin being installed in the stop seat, the stop pin being biased by the spring to cooperate with the first stop groove and the second stop groove; the connecting rod being installed in the body, the connecting rod being formed with a push surface to cooperate with the push lever of the first switching block, two ends of the connecting rod being provided with the buttons, the buttons extending out of the body; and sealing members being provided between the switching gear and the water diversion seat and between the connecting rod and each of the buttons, respectively.

2. The shower head capable of automatic switching and manual positioning as claimed in claim 1, wherein the body is formed with an oblique water trough between the water inlet channel and the water inlet, the oblique water trough is formed with an oblique opening facing the water inlet, and the rotor is installed in the oblique trough.

* * * * *